United States Patent [19]

Robson

[11] Patent Number: 4,670,195

[45] Date of Patent: Jun. 2, 1987

[54] CARBURETOR

[76] Inventor: Richard E. G. Robson, 245 Avondale Boulevard, Bramalea, Ontario L6T 1J3, Canada

[21] Appl. No.: 727,680

[22] Filed: Apr. 26, 1985

[51] Int. Cl.[4] ..... F02M 9/14

[52] U.S. Cl. ..... 261/41.5; 261/44.5; 261/DIG. 39; 261/DIG. 56

[58] Field of Search ..... 261/44.5, 41.5, DIG. 39, 261/DIG. 56

[56] References Cited

U.S. PATENT DOCUMENTS

| | | | |
|---|---|---|---|
| 995,919 | 6/1911 | Smith | 261/44 D |
| 1,239,173 | 9/1917 | Gavelek | 261/44 D |
| 1,441,992 | 1/1923 | Meden | 261/44 D |
| 1,565,972 | 12/1925 | Stewart | 261/44 D |
| 1,726,324 | 8/1929 | Udale | 261/44 D |
| 1,893,560 | 1/1933 | Newberry | 261/44 D |
| 1,927,090 | 9/1933 | Hess | 261/44 D |
| 1,990,702 | 2/1935 | Leibing | 261/44 D |
| 2,133,757 | 10/1938 | Smith | 261/44 D |
| 2,991,052 | 7/1961 | Carlson et al. | 261/DIG. 39 |
| 3,265,375 | 8/1966 | Morton | 261/63 |
| 3,472,495 | 10/1969 | Margee et al. | 261/DIG. 39 |
| 3,544,083 | 12/1970 | Currie | 261/41 D |
| 4,034,028 | 7/1977 | Ma | 261/44 D |

FOREIGN PATENT DOCUMENTS

| | | | |
|---|---|---|---|
| 88776 | 11/1921 | Austria | 261/DIG. 56 |
| 2839256 | 3/1980 | Fed. Rep. of Germany | 261/DIG. 56 |

*Primary Examiner*—Tim Miles

*Attorney, Agent, or Firm*—George A. Rolston

[57] ABSTRACT

A carburetor, for use in association with a liquid fuel, comprising a barrel means having bore-defining wall means, defining a bore therethrough, a central carburetor axis, an upstream end and a downstream end, an annular ridge forming a constriction in the barrel means, a dissipator body member of generally elongated globular pear-like shape having a maximum cross-section transverse to the barrel means complementary to and downstream of the constriction, the body member being mounted coaxially with the carburetor axis, fuel dissipating passageways through the body member for delivering fuel to the outer surface thereof downstream of the ridge, the ridge and the dissipator body member being movable relative to each other, to establish an annular air passage between the body member, and the downstream side of the ridge, and, fuel line means connecting the fuel dissipating passageways for receiving liquid fuel.

10 Claims, 5 Drawing Figures

CARBURETOR

THE NATURE OF THE INVENTION

The invention relates to a carburetor, and in particular to a carburetor of particularly advantageous use in multi-cylinder motor vehicle engines.

BACKGROUND OF THE INVENTION

In many standard internal combustion engine designs, fuel is mixed with air in a carburetor prior to introduction into a combustion cylinder. A carburetor introduces a pre-determined amount of fuel into the air flow, according to the power demand of the engine. In typical carburetor designs, fuel is released as a spray into the intake air from a fuel jet nozzle.

It is preferable in order to achieve maximum combustion efficiency and evenly balanced use of all engine cylinders that the fuel spray in the air flow be as atomized and as fine as possible. The standard carburetor designs attempt to achieve this characteristic by relying on the difference between the air and fuel pressures and velocities at the spray nozzle. Some fuel is vaporized as it is sprayed into the air flow. Additional fuel is vaporized while the fuel/air intake combination flows to the engine cylinders, but in many circumstances vaporization is not complete. Accordingly, maximum fuel efficiency and evenly balanced cylinder use are not achieved.

Furthermore. in many internal combustion engines, multi-cylinder (such as 6 or 8 cylinders) designs are often used. For example, in well known designs, the cylinders may be arranged in V-6, V-8, or in-line 6 configurations. In such designs if a single carburetor is used (as is often the case), it cannot be situated identically with respect to each cylinder. For instance, in a V-8 engine the carburetor is located at a mid-point between the two rows of cylinders. In such a position, the carburetor is located closer to the middle cylinders in each row than to the end cylinders of each row. When the air/fuel mixture containing the incompletely vaporized fuel is drawn into the engine, more fuel will enter the middle cylinders than will enter the end cylinders. Accordingly, the operation of the end cylinders is different in comparison to the middle cylinders, resulting in decreased engine performance. The mixture supplied to the end cylinders may be too lean, while the mixture supplied to the middle cylinders may be too rich. The engine acceleration is not maximized. The optimum power for a particular amount of fuel used is not extracted from any cylinders, or thus from the engine. Combustion efficiency is decreased, resulting in higher exhaust emissions, poor engine efficiency, decreased exhaust system life time, poor gas mileage, and increased maintenance requirements and costs.

It would therefore be advantageous to provide a carburetor which would vaporize as much of the gasoline being used as possible in the carburetor itself. Thereafter, an air/fuel mixture would essentially be totally gaseous. In such a form, the air/fuel mixture would be directed more or less evenly to each of the cylinders. The cylinders would therefore operate and wear more or less evenly. The maximum amount of power would be extracted from a given amount of fuel. Furthermore, clean burning would be maximized, resulting in improved engine efficiency or gas mileage, decreased exhaust emissions, improved exhaust sytem life time, and decreased maintenace requirements and costs.

Another problem is created by the movement of the vehicle, causing fuel starvation of the cylinders ahead of the carburetor, and over supply of fuel to the cylinders to the rear.

This results from the fact that the air stream and entrained fuel are required to flow from the carburetor into an intake manifold.

The manifold is aligned along the axis of movement of the vehicle. Consequently the concentration of fuel droplets in the air/fuel flow will tend to be reduced, in the forward direction, and increased in the rearward direction. This phenomenon also occurs in the barrel of the carburetor. Fuel droplets will tend to be deflected to the rearward portion of the barrel, even as they are ejected from the carburetor jets.

STATEMENT OF THE INVENTION

With a view to providing the above advantages and to overcoming the above disadvantages, the invention comprises a carburetor, for use in association with a liquid fuel, comprising a barrel defining a bore therethrough, a central carburetor axis, an upstream end and a downstream end and a constriction forming a throat, a dissipator body member, mounted coaxially with the carburetor axis, and defining fuel dissipating passageway means therethrough said body being shaped to complement said constriction, one of said barrel means and said dissipator body member being movable relative to the other, movement means for moving at least one of said constrictions and said dissipator body member, whereby to establish an air passage between said constriction and said body member, fuel line means connecting the fuel dissipating passageway means to a fuel supply means.

The invention achieves the above advantages by means of the following principles. A barrel of generally circular cross-section is provided through which air may pass. A central fuel dissipator body member is located coaxially within the barrel. A constriction forming a venturi throat is located inside the barrel.

Either of the dissipators or the constriction is movable relative to the others and is operable by means of a throttle linkage mechanism, whereby it may be moved upstream and downstream. Air is drawn through the barrel between venturi-like surfaces of the construction and the dissipator. Fuel is metered through multiple radial passages in the dissipator body. Fuel is drawn from the annular channel in the body by the negative pressure developed at the throat. As the fuel reaches the outer surface of the body, it is evaporated or sheared away by the fast-flowing airstream all around the perameter of the body. Excess liquid fuel may form a thin film on the surface of the dissipator body. Evaporation or entrainment of the fuel continues from the thin film. A fine, essentially gaseous, air/fuel mixture results which is evenly distributed all across the cross-section of the interior of the barrel. The presence of larger fuel droplets is substantially reduced since fuel is entrained in air in an essentially annular throat zone all around the wall of the barrel.

Air/fuel mixture then enters the inlet manifold, equalised as between upstream and downstream flow paths.

The various features of novelty which characterize the invention are pointed out with particullarity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
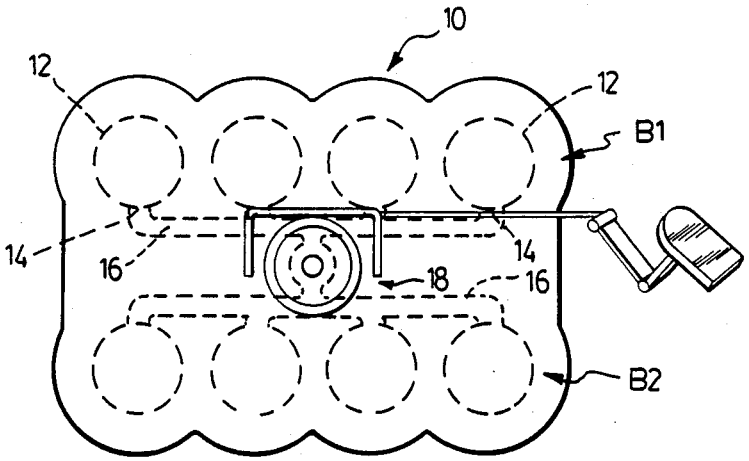
FIG. 1 is a schematic view of a vehicle engine, to which is mounted one embodiment of a carburetor according to the invention.

Referring to FIG. 1 there is schematically shown a carburetor according to the invention, illustrated by way of example in use on an internal combustion engine, indicated generally as 10. Engine 10 in this example is a V-8 engine, having eight cylinders 12. Each cylinder has an intake 14, which receives air/fuel mixture through manifold 16. Cylinders 12 define two cylinder banks B1 and B2. A manifold 16 serves each of banks B1 and B2.

Manifolds 16 are connected to and receive an air/fuel mixture from a carburetor, indicated generally as 18, according to the invention.

It will be appreciated that, although a V-8 engine is shown, the carburetor according to the invention could be used in any engine with any number of cylinders. Use of a carburetor according to the invention would be particularly advantageous in any multi-cylinder engine in which the cylinders were not all evenly disposed relative to the carburetor. Accordingly, it is not intended to limit the scope of the invention to the particular vehicle engine shown or described. Rather, it is intended that the scope of the invention cover any embodiment of the invention in any application where a carburetor according to the invention may be used.

Also while the carburetor is illustrated in a downdraft mode, it could with modification be used in a side draft or updraft mode, and located to one side of the cylinder block. Such words as "upward", "downward", and the like as used in this specification are not intended to limit the scope of the invention, but rather are used only to assist in the explanation of one embodiment of the invention.

Figure 2:
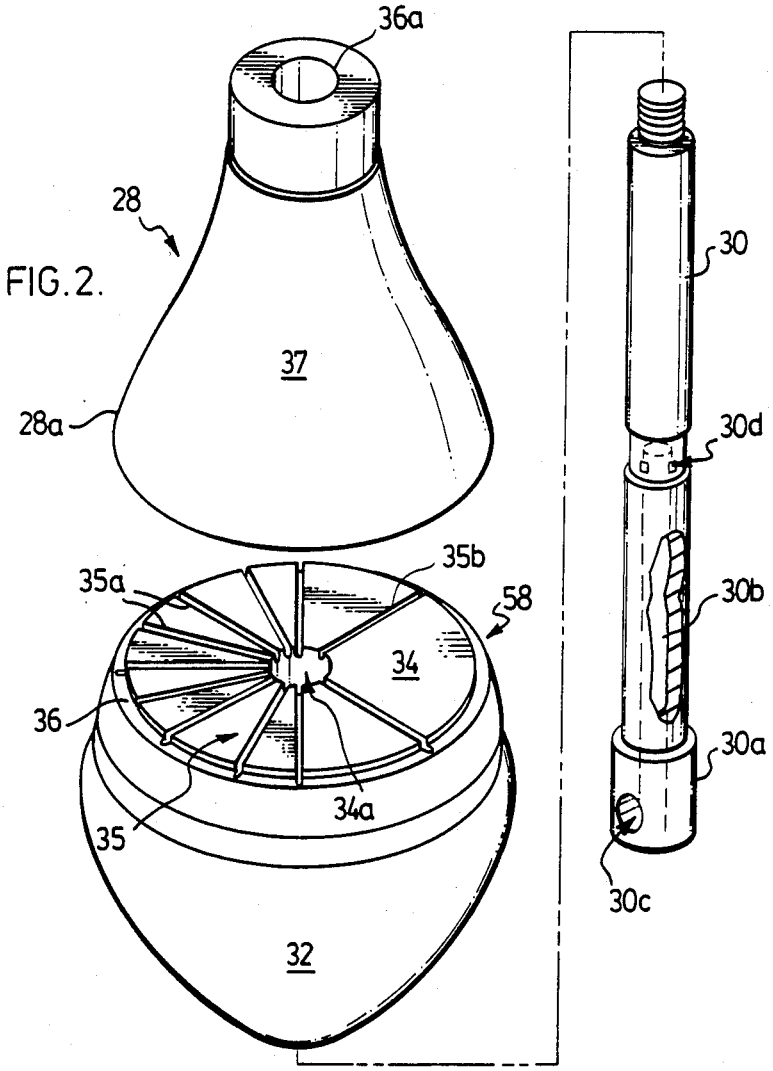
FIG. 2 is an expanded perspective drawing of part of the carburator according to the invention.
Figure 3:
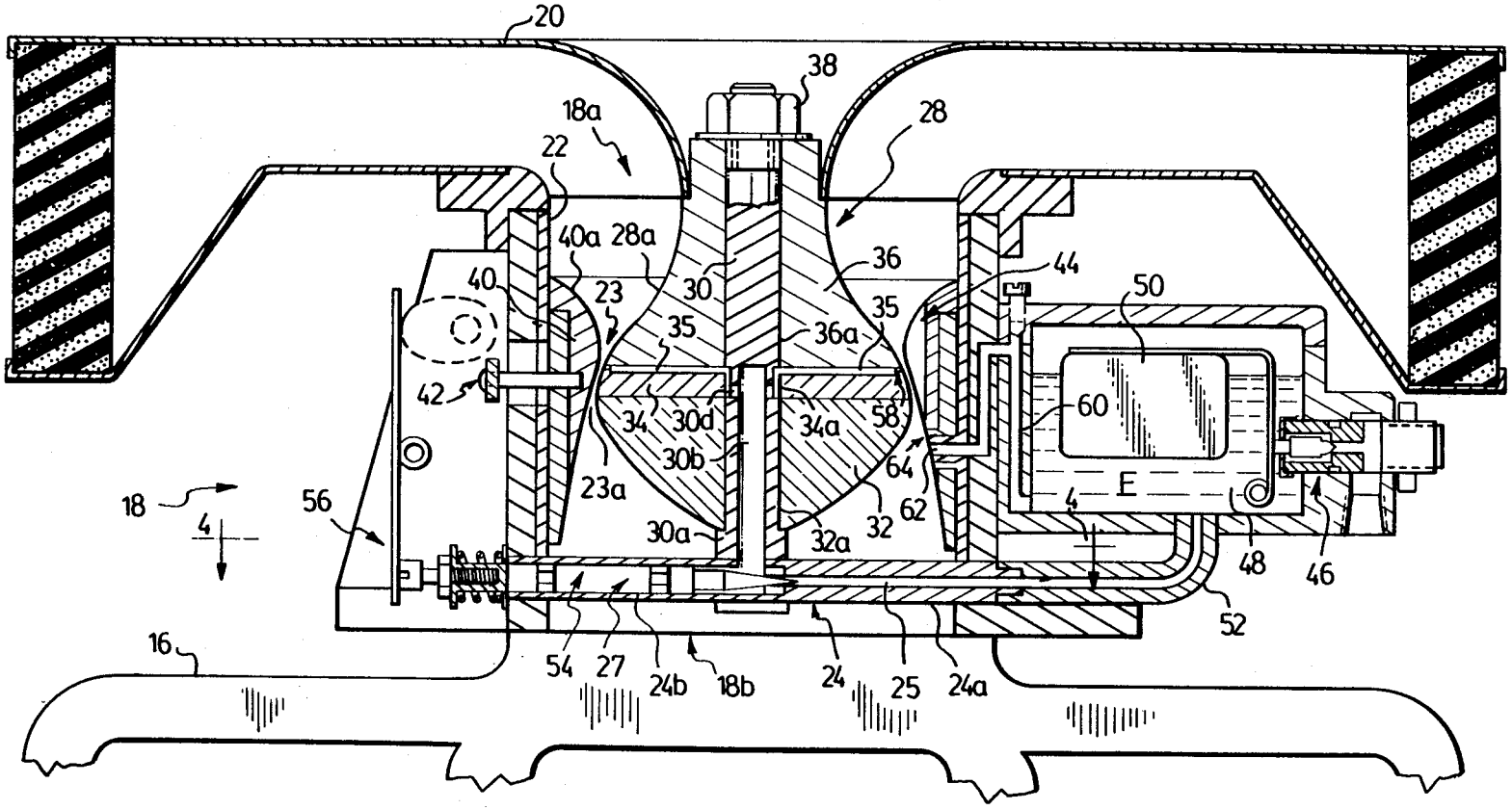
FIG. 3 is a vertical cross-section of a carburetor according to the invention.

Referring to FIGS. 2 and 3, the carburetor 18 defines an intake, or upstream, end 18*a* and an outlet, or downstream, end 18*b*. Downstream end 18*b* is connected to manifolds 16. The upstream end 18*a* is connected to air filter means 20. Accordingly, air is drawn into and through air filter means 20, carburetor 18, and manifold 16 by the vacuum suction developed in cylinders 12. As explained below, air passing through carburetor 18 evaporates or entrains fuel, which is drawn into cylinders 12 and subsequently burned therein.

Carburetor 18 comprises an outer barrel means 22 which is mounted to manifolds 16 and engine 10. At the upstream end 18*a*, the edge of barrel 22 is smoothly flared radially outwardly in order to reduce drag, turbulence, pressure drop, and consequent inefficiency at the entrance to carburetor 18. Barrel means 22 defines a central carburetor axis and a central bore which is preferably clyindrical.

A dissipator body or block member 28 is mounted coaxially with barrel 22 by a suitable support means which in the illustrated embodiments comprises a support spider apparatus 24. Spider 24 is affixed to the bottom of the inner wall of barrel 22 adjacent the outake end 18*b*. Spider 24 may have any number of arms 24*a*, 24*b*, etc., extending radially from the axis of carburetor 18 to barrel 22. However, four arms have been found to be a particularly convenient number, providing an optimum amount of support in relation to the obstruction of air flow, and allowing for a convenient valve arrangement, as described below. It will be appreciated that other means for coaxially supporting dissipator block 28 may be used.

Dissipator block member 28 is mounted to the centre of support spider 24 coaxially with barrel 22. Preferably, dissipator block 28 is symmetrical about the carburetor axis defining a circular periphery at its maximum diameter, and having a generally elongated globular shape somewhat in the form of a droplet, or a pear. It defines a longitudinal axis, with more or less partly pointed upper and lower ends, on the axis, and a generally enlarged mid portion, which is circular in cross-section. The outer surface of dissipator block 28 defines a smooth, aerodynamically-shaped venturi-like surface 28*a*.

For ease of manufacture, assembly, and maintenance, dissipator block 28 may comprise several components fixed together. A central post 30 may be mounted to the support spider 24. A lower venturi block 32, defining a central bore 32*a*, is slid into place over post 30. The lower end of lower venturi block 32 may abut against a shoulder 3*a* defined by the bottom of post 30.

Metering block 34 is a generally disc-shaped member defining a central bore 34*a*. Metering block 34 is slid into place over post 30 on top of lower venturi block 32.

Fuel distribution passageways comprising radial channels 35 are formed in metering block 34.

A fuel dissipator ledge 36 is formed around the exterior of block 34, and connects with the outer ends of channels 35. Upper venturi block 37 having a central bore 36*a* in turn is fitted onto post 30 on top of metering block 34. Upper venturi block 37 defines a flat undersurface.

Lower and upper venturi block 32 and 37 and metering block 34 are sized so that the upper surface of metering block 34 lies approximately adjacent to, in the illustrated embodiment somewhat above, the point of widest diameter of dissipator block 28. The various components of block 28, namely, lower venturi block 32, metering block 34, and upper venturi block 37, are held together on post 30 by a suitable fastening means 38.

A constriction ridge 40 of generally annular shape is located on the inside of barrel 22. Ridge 40 defines an inner, smoothly aerodynamically-shaped, venturi-like surface 40*a*. Surface 28*a* of body 28 and surface 40*a* define a venturi-like air passage or bore 23 therebetween, having a throat opening 23*a*.

Ridge 40 is movable within barrel 22. Downward movement of ridge 40 will cause surface 40*a* to contact surface 28*a*, thereby reducing flow of air through carburetor 18. Ridge 40 is upwardly movable to a predetermined maximum open position, whereby air passage 23 is at its widest and a maximum amount of air may flow through carburetor 18. Ridge 40 may be moved to any intermediate position thereby controlling the flow of air between a minimum and maximum. Ridge 40 is connected to a throttle linkage means, indicated generally as 42, operable to move the deflector 40 upwardly or downwardly, according to the power requirements of the engine 10.

Ridge 40 defines a relatively small slotted idle opening 44 at one side. Idle opening 44 is dimensioned so that when ridge 40 is in the closed position against dissipator block 28, a predetermined minimum flow of air may pass through idle opening 44.

Fuel F flows from a gasoline line (not shown) through a float needle valve means 46 into a fuel chamber 48. A float 50 floats on top of fuel F within chamber 46, whereby the level of fuel F can be maintained at a constant level in chamber 48.

Figure 4:
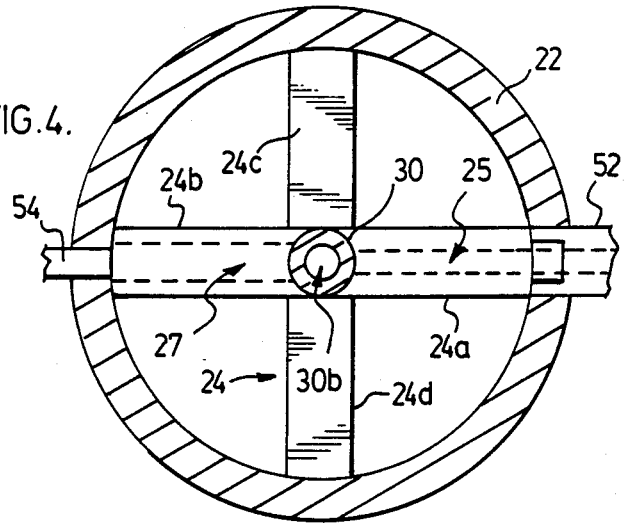
FIG. 4 is a partial section along 4—4 of FIG. 3 showing the spider, and, FIG. 5 is a schematic view of an alternate embodiment.

A gasoline tube 52 connects the bottom of chamber 48 to one of spider arm 24*a*. Spider arm 24*a* defines an internal bore 25, adapted to connect with gasoline tube 52 (see FIGS. 3 and 4).

The lower portion of post 30 defines a central bore 30*b* and a cross bore 30*c* whereby bore 25 of spider arm 24*a* may communicate with bore 30*b*.

A spider arm 24*b*, diametrically opposed to arm 24*a*, defines central bore 27. Bore 27 is adapted to support a valve means 54. Valve means 54 is operable to control the flow of fuel from bore 25 to bore 30*c*. Valve means 54 in turn is connected to and controlled by a valve throttle means 56. Valve throttle means 56 may be connected (not shown) to throttle linkage means 42, whereby the positions of ridge 40 and valve throttle means 56 may be controlled in corresponding relationship to each other. With such a connection therebetween the flow of fuel to the engine may be increased at the same time as the flow of air to the engine is increased, thereby allowing for increased engine power. Alternatively, valve throttle means 56 may be controlled by suitable means independent of throttle linkage means 42.

Post 30 defines additional openings 30*d*, whereby by bore 30*b* can communicate with channels 35 in metering block 34.

Referring to FIG. 2, metering block 34 is shown in somewhat more detail. The upper surface of metering block 34 defines a plurality of radially extending passageways or channels 35. If carburetor 18 is mounted to engine 10 so that channels 35 do not lie in a horizontal plane, gravity may influence the amount of fuel flowing in each channel 35. Accordingly, in order to counterbalance the effect of gravity, channels 35 may be tilted. Similarly, if engine 10 is mounted to a moving vehicle, more of such channels 35*a* are grouped so as to extend in a forward direction (that is, in the direction in which the vehicle is most likely to accelerate) and fewer channels 35*g* in a rearward direction. On the other hand, if engine 10 is intended to operate primarily in a stationary position and channels 35 lie essentially in a horizontal plane, channels 35 will be more or less evenly disposed around metering block 34. Channels 35 extend radially outwardly from central bore 34*a*, but stop short of the outer venturi surface 28*a*.

When metering block 34 is mounted in place ledge 36 and the lower surface of upper venturi block 37 define a relatively narrow but deep annular groove 58. Groove 58 is preferably located slightly upstream of the widest portion of body 28.

A more or less conventional idle jet means 60 extends from the bottom of chamber 48 to an idle nozzle 62, located below idle opening 44. Ridge 40 defines a suitable idle jet opening 64, whereby gasoline may be drawn from idle nozzle 62 into air passage 23 below idle opening 44 without interference from ridge 40.

In operation, the idle jet means 60 and the valve throttle means 56 are adjusted to provide the desired engine operating characteristics at idle and high speeds, respectively.

At low or idle speed and low power requirements, throttle linkage means 42 locates ridge 40 at its closed position. The surface 40*a* contacts the surface 28*a* of dissipator 28, essentially closing off carburetor 18 to the flow of air. A minimal amount of air however continues to flow through idle opening 44 past nozzle 62. Fuel F flows from chamber 48 through idle jet means 60 and nozzle 62 into air passage 23. Air flowing through idle opening 44 entrains and at least partially evaporates the fuel drawn from nozzle 62 and the air/fuel mixture flows into manifolds 16 to cylinders 12. In the idle position, the operating characteristics of carburetor 18 are essentially the same as those of any conventional carburetor.

When it is desired or required to increase the power input of engine 10, the quantities of both fuel and air flowing to cylinders 12 must be increased. Accordingly, to increase the air flow, throttle linkage means 42 is operated to move ridge 40 upwardly thereby opening air passage 23 between dissiaptor block 28 and ridge 40. Valve means 54 is more or less simultaneously also opened up, allowing fuel F to flow from chamber 48 through pipe 52 and bores 25, 30*c*, 30*b* and 30*d*, to channels 35 and annular groove 58. Fuel passes from each of channels 35 into annular groove 58. Upon entering groove 58, fuel is able to flow both radially and circumferentially to essentially fill groove 58. Fuel flows from groove 58 onto venturi-like surface 28*a*.

Because of the venturi-like shapes of surfaces 28*a* and 40*a*, air is flowing at a relatively high speed adjacent groove 58. Such high speed air shears off and entrains much of the fuel emerging from groove 58 onto surface 28*a*. Excess fuel not immediately entrained forms a thin film flowing downstream from annular groove 58 on surface 28*a*.

The continuing air flow past surface 28*a* evaporates or shears off and entrains additional fuel from the fuel film. Essentially all fuel is evaporated or sheared away from block 28 in such fashion.

By the increase in the overall dimensions of the barrel, and by constricting the central portion, air flow is confined to an annular region of an effective width less than that of the diameter of the barrel of a conventional carburetor. This enhances the venturi effect, while still providing adequate cross-sectional area for adequate ventilation having regard to the engine capacity.

This produces more efficient fuel dissipation, and better equalisation of fuel to all cylinders.

Fuel is entrained by the air in a finely atomized form because of the relatively large area of block 28 over which fuel is dispersed. The finely atomized droplets of fuel allow for improved evaporation of the fuel. As well, the fine droplets themselves behave similarly to a fuel vapour in engine 10, resulting in improved performance.

Because the ridge 40 and the dissipator block 28 may not form a theoretically perfect venturi therebetween, there will be some air turbulence adjacent lower venturi block 32. Such turbulence may assist in the evaporation of fuel from the fuel film. In addition, turbulence in carburetor 18 can be increased if desired by any suitable means, well known to persons skilled in the art.

The air/fuel mixture exiting from the carburetor is more nearly gaseous than in the past. Such mixture is able to flow relatively evenly to each of the cylinders 12 of engine 10 through manifolds 16, thus allowing for improved operation of engine 10.

As power requirements and engine speed increase, ridge 40 is moved upwardly by throttle linkage means 42. More or less simultaneously, valve means 54 through valve throttle means 56 opens up to increase the flow of fuel F to the annular groove 58.

In other embodiments, the air filter means 20 may incorporate angled or spiral vanes therein in order to induce a swirling motion into the air as it enters carburetor 18. Additional improvements in fuel entrainment and evaporation may result.

In another embodiment, the dissipator block 28 may be rotatably coaxially mounted within barrel 22. Rotation of dissipator block 28 during operation results in additional movement of the fuel on block 28 relative to the air flow, thus providing further improvements in fuel entrainment and evaporation, at the possible expense of reliability and simplicity.

In yet other embodiments, different support spider means may be used to support dissipator block 28. Similarly, different valve means 54 may also be used. For example, fuel could be passed by a suitable tube through the top, rather than the bottom, of dissipator block 28 to channel 58.

Figure 5:
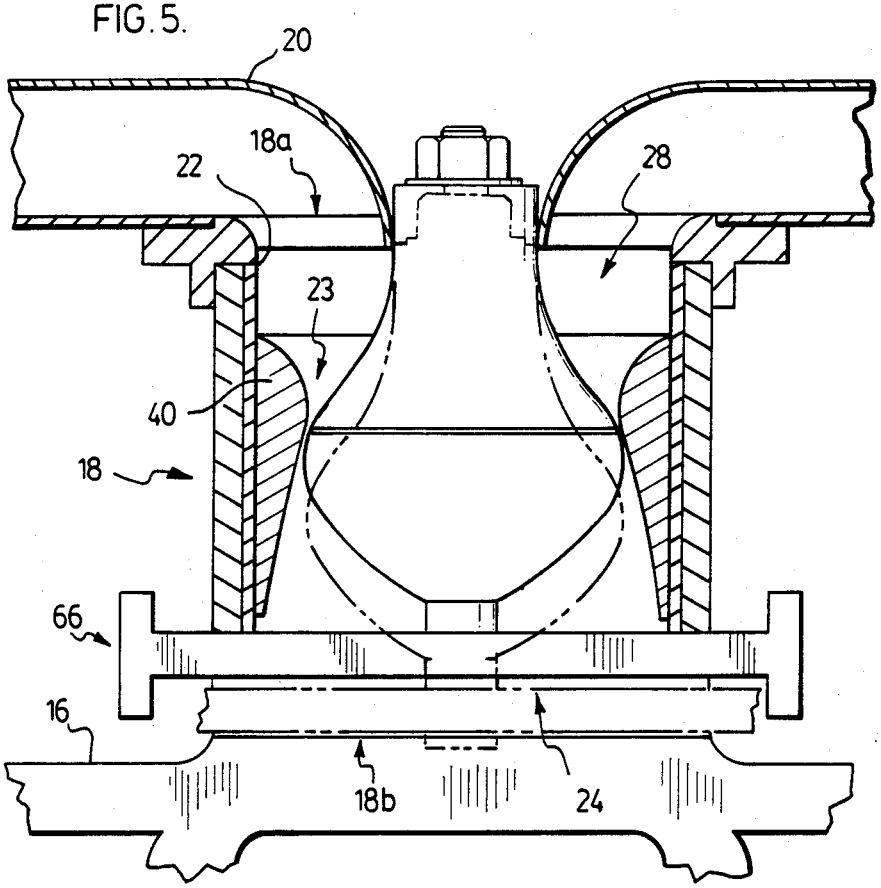

In yet another embodiment, as schematically shown in FIG. 5, ridge 40 may be fixed relative to barrel 22. In fact, ridge 40 may comprise part of the barrel means 22. The barrel means 22 may define the narrow throat. Dissipator body or block 28 may be made movable relative to barrel 22 and ridge 40, by means of throttle linkage means 66.

In general therefore the invention provides that either the ridge, or the dissipator, is movable relative to the others, to open and close the throat. The throat comprises an essentially annular zone, of varying cross-section. Fuel is metered into the throat in an all-round annular fashion.

Generally, the invention will thus require a carburetor having a barrel with a diameter larger than that of the conventional carburetor barrel, since the dissipator body according to the invention will always reduce the overall cross-sectional area available for air flow.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A carburetor, for use in association with a liquid fuel powered engine in a vehicle comprising:

a cylindrical barrel means having bore-defining wall means, defining a bore therethrough, a central carburetor axis, an upstream and a downstream end and a forward and rearward side;

an annular ridge member forming a constriction in said barrel means and having an upstream and a downstream side;

a dissipator body member of generally elongated globular pear-like shape located downstream of said annular ridge member and having a maximum cross-section transverse to said barrel means complementary to said annular ridge member, said body member being mounted coaxially with said central carburetor carbuetor axis and being adapted to close said barrel means in the region of said downstream side of said annular ridge member;

fuel dissipating means formed through said body member for delivering fuel to the outer surface of said body member downstream of said ridge member said passageway means being configured to deliver more fuel to said forward side of said barrel means, and less fuel to said rearward side of said barrel means;

one of said ridge member and said dissipator body member being movable relative to the other;

movement means for moving said movable one of said ridge member and said dissipator body member, whereby to establish an annular air passage between said body member, and said downstream side of said annular ridge member whereby air flowing in said barrel means from said upstream end to said downstream end is forced to flow first through said constriction and then around said maximum cross-section of said body member; and, fuel line means connecting said fuel dissipating passageway means for receiving said liquid fuel.

2. A carburetor, for use in association with a liquid fuel powered engine in a vehicle comprising:

a cylindrical barrel means having a bore-defining wall means, defining a bore therethrough, a central carburetor axis, an upstream end and a downstream end and a forward and rearward side;

an annular ridge member forming a constriction in said barrel means and having an upstream and a downstream side;

a dissipator body member of generally elongated globular pear-like shape located downstream of said annular ridge member and having a maximum cross-section transverse to said barrel means complementary to said annular ridge member, said body member being mounted coaxially with said central carburetor axis and being adapted to close said barrel means in the region of said downstream side of said annular ridge member;

a plurality of radial fuel dissipating passageways formed through said body member for delivering fuel to the outer surface of said body member downstream of said ridge member said passageways comprising a forward group and a rearward group wherein there are a greater number of said passageways in said forward group and a lesser number of said passageways in said rearward group;

one of said ridge member and said dissipator body member being movable relative to the other;

movement means for moving said moveable one of said ridge member and said dissipator body member, whereby to establish an annular air passage between said body member, and said downstream side of said annular ridge member whereby air flowing in said barrel means from said upstream end to said downstream end is forced to flow first through said constriction and then around said maximum cross-section of said body member and, fuel line means connecting said fuel dissipating passageways for receiving said liquid fuel.

3. A carburetor as claimed in claim 2 including support arm means extending into said barrel means, said dissipator body member being mounted to said support arm means, and wherein said barrel means comprises an outer wall means and said ridge member being located thereon defining said constriction and being movable relative to said outer wall means.

4. A carburetor as claimed in claim 2 including throttle support means connected to said dissipator body member, operable to move said dissipator body member along said carburetor axis relative to said annular ridge.

5. A carburetor as claimed in claim 2 wherein said ridge member and said dissipator body member define external surfaces shaped in venturi-like fashion, said surfaces being adapted to cooperate with each other whereby to define an adjustable annular venturi-like passageway therebetween.

6. A carburetor as claimed in claim 5 wherein said ridge member defines an idle air passageway extending through said downstream side there of and including an idle jet means located downstream of said idle air passageway.

7. A carburetor as claimed in claim 6 including a fuel valve means in said fuel line means, operable to control the flow of fuel to said fuel dissipating passageways.

8. A carburetor as claimed in claim 7 including a central bore extending partially through said dissipator body member and said plurality of radial passageways extending radially outwardly from said central bore.

9. A carburetor as claimed in claim 8 including an annular channel extending around said dissipator body member in communication with each of said radial passageways.

10. A carburetor as claimed in claim 9 wherein said annular channel is located approximately adjacent said maximum cross-section of said dissipator body member.

* * * * *